US008393094B1

(12) United States Patent
Legenza

(10) Patent No.: US 8,393,094 B1
(45) Date of Patent: Mar. 12, 2013

(54) SNOW REMOVAL ASSEMBLY AND METHOD

(76) Inventor: Brian Legenza, Kansas City, MO (US)

( * ) Notice: Subject to any disclaimer, the term of this patent is extended or adjusted under 35 U.S.C. 154(b) by 267 days.

(21) Appl. No.: 12/704,308

(22) Filed: Feb. 11, 2010

(51) Int. Cl.
*E01H 5/00* (2006.01)

(52) U.S. Cl. ..... 37/196; 37/197; 52/578

(58) Field of Classification Search ..... 383/4; 294/1.1; 37/197, 196; 52/578; 428/101
See application file for complete search history.

(56) References Cited

U.S. PATENT DOCUMENTS

| | | | | |
|---|---|---|---|---|
| 2,540,380 | A | 2/1951 | Schultheis | |
| 2,578,135 | A | 12/1951 | Hoigaard et al. | |
| 3,202,193 | A * | 8/1965 | Ware | 383/37 |
| 4,632,329 | A | 12/1986 | Burley | |
| 4,646,818 | A | 3/1987 | Ervin, Jr. | |
| 4,964,187 | A * | 10/1990 | Dell'Orto | 15/161 |
| 4,991,324 | A | 2/1991 | Fine et al. | |
| 5,349,550 | A | 9/1994 | Gage | |
| 5,550,349 | A * | 8/1996 | Bomba | 219/213 |
| 5,660,402 | A * | 8/1997 | Jones et al. | 280/19 |
| D403,547 | S | 1/1999 | Adkins | |
| 6,051,811 | A | 4/2000 | Hardison | |
| 6,211,493 | B1 * | 4/2001 | Bouman | 219/213 |
| 6,505,444 | B1 * | 1/2003 | Johnson | 52/177 |
| 6,949,278 | B2 | 9/2005 | Saitoh | |
| 6,993,801 | B2 * | 2/2006 | Marko et al. | 14/69.5 |
| 7,138,026 | B1 * | 11/2006 | Stoller | 156/229 |
| 2003/0026946 | A1 | 2/2003 | Chhun | |
| 2005/0204676 | A1 * | 9/2005 | Weitzer | 52/578 |
| 2010/0008601 | A1 * | 1/2010 | Prudencio | 383/4 |

* cited by examiner

*Primary Examiner* — Jamie L McGowan

(57) ABSTRACT

A snow removal assembly includes a covering that is positionable on a ground surface. The covering includes a plurality of panels that are slidably coupled together to allow a combined length of the panels to be selectively lengthened or retracted. The covering is lengthened to a selected length and placed on the ground surface. The covering may then be moved to remove any snow which falls on the covering to leave an exposed ground surface.

6 Claims, 3 Drawing Sheets

SNOW REMOVAL ASSEMBLY AND METHOD

BACKGROUND OF THE DISCLOSURE

Field of the Disclosure

The disclosure relates to snow removal devices and more particularly pertains to a new snow removal device for assisting a person in removing snow from their walkway.

SUMMARY OF THE DISCLOSURE

An embodiment of the disclosure meets the needs presented above by generally comprising a covering that is positionable on a ground surface. The covering includes a plurality of panels that are slidably coupled together to allow a combined length of the panels to be selectively lengthened or retracted. The covering is lengthened to a selected length and placed on the ground surface. The covering may then be moved to remove any snow which falls on the covering to leave an exposed ground surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
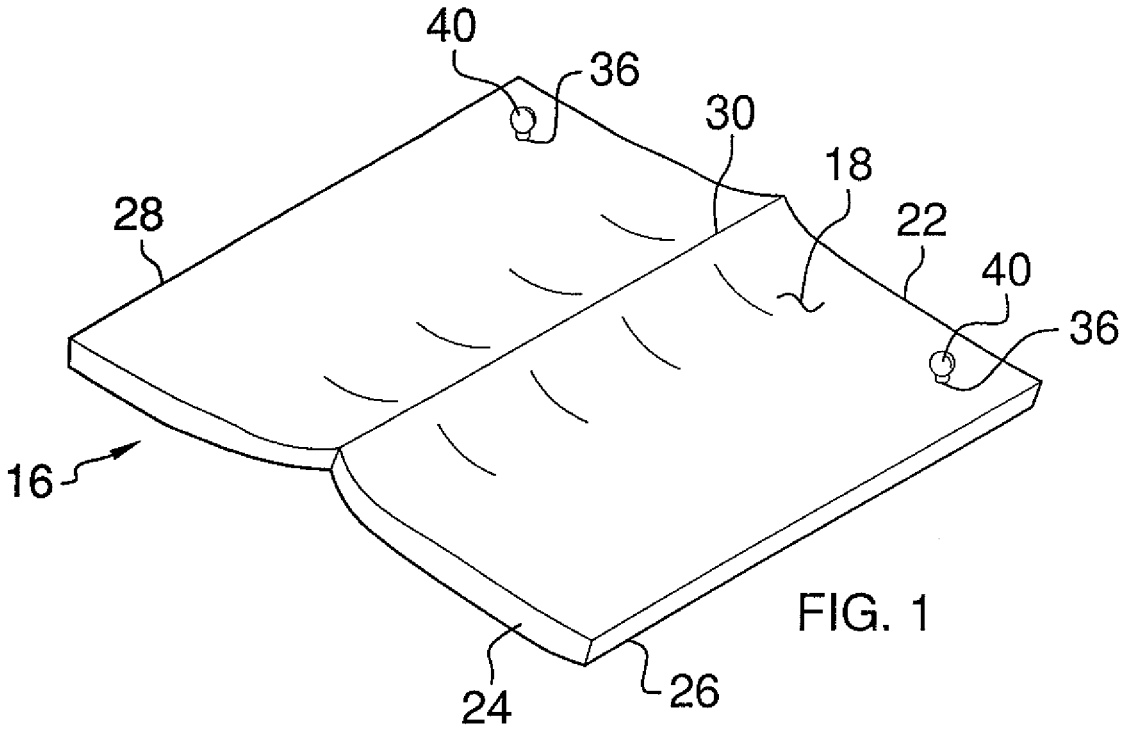
FIG. 1 is a top perspective view of a panel of a snow removal assembly and method according to an embodiment of the disclosure.
Figure 2:
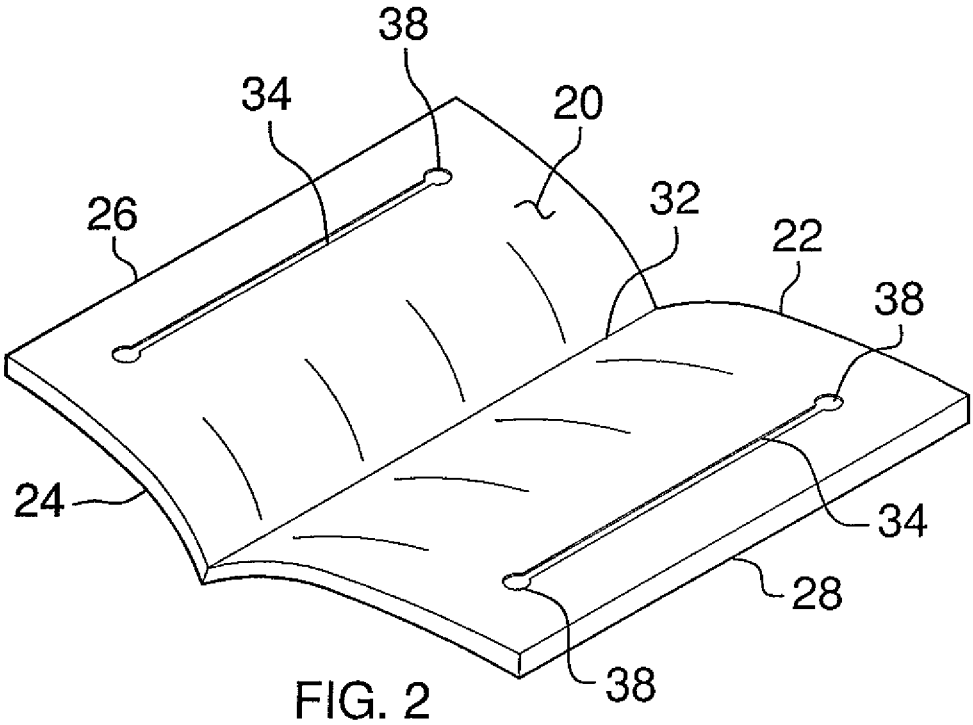
FIG. 2 is a bottom perspective view of an embodiment of the disclosure.
Figure 3:
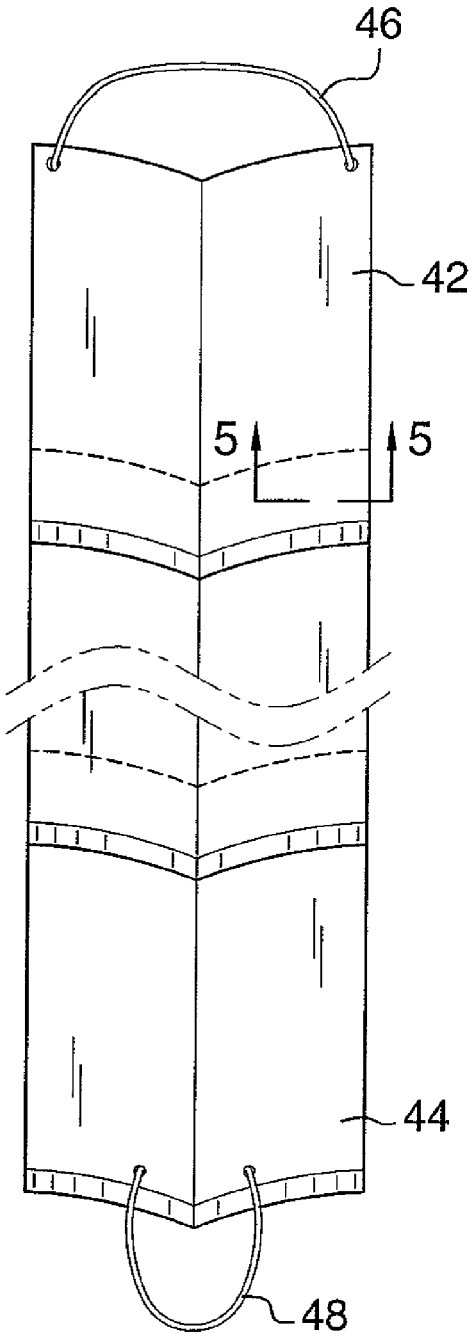
FIG. 3 is a top view of an embodiment of the disclosure.

With reference now to the drawings, and in particular to FIGS. 1 through 6 thereof, a new snow removal device embodying the principles and concepts of an embodiment of the disclosure and generally designated by the reference numeral 10 will be described.

As best illustrated in FIGS. 1 through 6, the snow removal assembly 10 and method generally comprises positioning a covering 12 on a ground surface. More particularly, the ground surface will likely encompass a walkway 14 such as a sidewalk but may also include any area where snow needs to be removed such as driveways, patios, parking spaces and the like. The covering 12 includes a plurality of panels 16 that are slidably coupled together to allow a combined length of the panels 16 to be selectively lengthened or retracted. The panels 16 are comprised of a plastic or elastomeric material.

Each of the panels 16 may have a top side 18, a bottom side 20, a first end edge 22, a second end edge 24, a first lateral edge 26 and a second lateral edge 28. A raised apex 30 is positioned in the top side 18 and is located between the first 22 and second 24 lateral edges and extends from the first end edge 22 to the second end edge 24. Corresponding to the raised apex 30, an elongated indent 32 is positioned in the bottom side 20 between the first 22 and second 24 lateral edges and extends from the first end edge 22 to the second end edge 24. The indent 32 and apex 30 add rigidity to the panel 16 to prevent it from bending along a line extending through the first 22 and second 24 lateral edges. A pair of elongated slots 34 is positioned the bottom side 20. Each of the slots 34 is elongated along a line orientated parallel to the first lateral edge 26. One of the slots 34 is positioned adjacent to the first lateral edge 26 and one of the slots is positioned adjacent to the second lateral edge 28. A pair of posts 36 is attached to the top side. The posts 36 are positioned adjacent to the first end edge 22 and are spaced from each other. Each of the posts 36 is positioned in and slidable along the slots 34 in another one of the panels 16. The slots 34 may include widened ends 38 to assist in receiving bulbous ends 40 of the posts 36. This allows the panels 16 to be removed from each other or attached to each other as needed.

Figure 5:
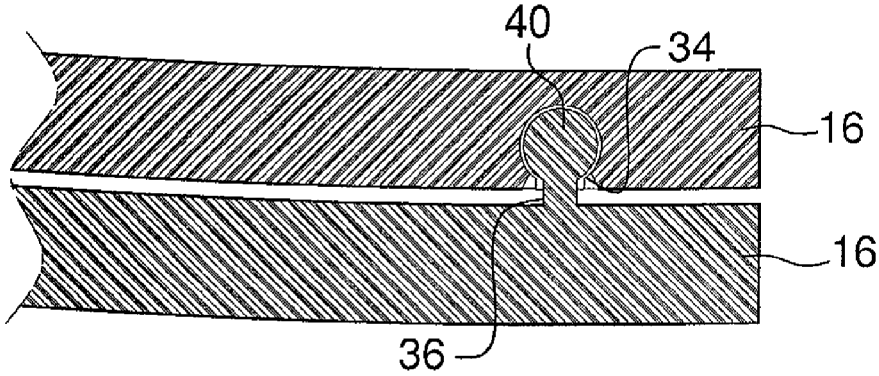
FIG. 5 is a cross-sectional view of an embodiment of the disclosure taken along line 5-5 of FIG. 3.
Figure 6:
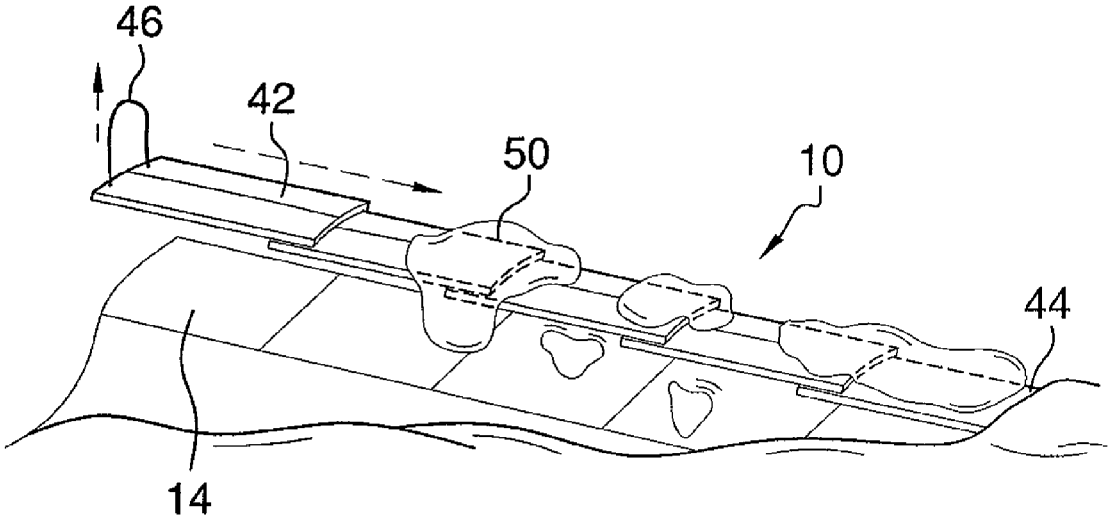
FIG. 6 is a perspective in-use view of an embodiment of the disclosure.

The plurality of panels 16 includes a first panel 42 and a last panel 44 wherein remaining ones of the plurality of panels 16 are positioned between the first 42 and last 44 panels. The first panel 42 has a handle 46 coupled thereto and the last panel 44 has a strap 48 coupled thereto to allow for more easy movement of the covering 12. The first panel 42 is free of any of the posts 36 being attached thereto, though the posts 36 of the next adjacent panel 16 will extend into the slots 34 of the first panel 42 as shown in FIG. 5.

Figure 4:
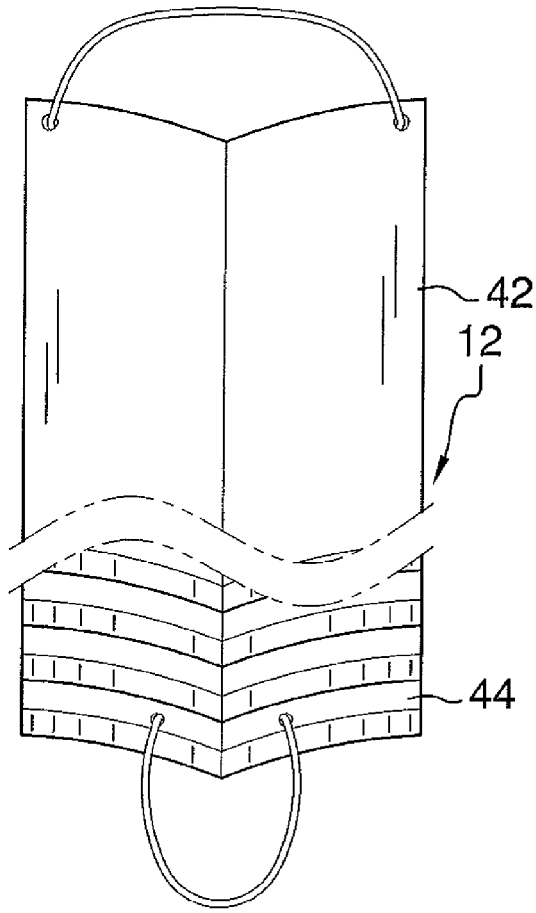
FIG. 4 is a top view of an embodiment of the disclosure.

In use, the covering 12 is lengthened, or retracted, to a selected length and positioned on the walkway 14. Snow 50 is then allowed to fall onto the covering 12. The covering 12 is then picked up to remove snow 50 from the ground surface covered by the covering 12. This exposes the walkway 14 below and leaves the walkway 14 free of any snow 50. The term snow is being used to define any form of freezing precipitation such as sleet, ice and freezing rain. When finished, the panels 16 may be slid together to form a more compact assembly 10 for storage as shown in FIG. 4.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A method of removing snow, said method comprising the steps of:

positioning a covering on a ground surface, said covering including a plurality of panels, said panels being slidably coupled together to allow a combined length of said panels to be selectively lengthened or retracted, each of said panels having;

a top side, a bottom side, a first end edge, a second end edge, a first lateral edge and a second lateral edge, a raised apex being positioned in said top side and being located between said first and second lateral edges and extending from said first end edge to said second end edge, an elongated indent being positioned in said bottom side between said first and second lateral edges and extending from said first end edge to said second end edge;

a pair of elongated slots being positioned in said bottom side, each of said slots being elongated along a line orientated parallel to said first lateral edge, one of said slots being positioned adjacent to said first lateral edge and one of said slots being positioned adjacent to said second lateral edge;

a pair of posts being attached to said top side, said posts being positioned adjacent to said first end edge and being spaced from each other, each of said posts being positioned in and slidable along said slots in another one of said panels;

said plurality of panels including a first panel and a last panel wherein remaining ones of said plurality of panels are positioned between said first and last panels, said first panel having a handle coupled thereto, said last panel having a strap coupled thereto, said first panel being free of any of said posts;

lengthening said covering to a selected length;

allowing snow to fall on said covering; and picking up said covering to remove snow from the ground surface covered by said covering.

2. A snow removing assembly to assist a person in removing snow from a walkway, said assembly comprising:

a covering being positionable on a ground surface, said covering including a plurality of panels, said panels being slidably coupled together to allow a combined length of said panels to be selectively lengthened or retracted by slidably moving said panels with respect to each other; and wherein said covering is lengthened to a selected length and placed on the ground surface, said covering being moved to remove any snow which falls on said covering to leave an exposed ground surface;

a top side, a bottom side, a first end edge, a second end edge, a first lateral edge and a second lateral edge;

a pair of elongated slots being positioned in said bottom side, each of said slots being elongated along a line orientated parallel to said first lateral edge, one of said slots being positioned adjacent to said first lateral edge and one of said slots being positioned adjacent to said second lateral edge; and a pair of posts being attached to said top side of each said panel positioned beneath an adjacently positioned said panel, said posts being positioned adjacent to said first end edge and being spaced from each other, each of said posts being positioned in and slidable along said slots in another one of said panels, each of said posts including;

a first section attached to said top side, said first section comprising a shaft extending into one of said slots; and a second section attached to said first section, said second section comprising a bulbous member removably positioned within one of said slots, each of said slots having a widened end to removably receive said bulbous member, said slots retaining said bulbous member when said bulbous member is within one of said slots and spaced from said widened end.

3. The assembly according to claim 2, wherein each of said panels further includes a raised apex being positioned in said top side and being located between said first and second lateral edges and extending from said first end edge to said second end edge, an elongated indent being positioned in said bottom side between said first and second lateral edges and extending from said first end edge to said second end edge.

4. The assembly according to claim 3, wherein said plurality of panels including a first panel and a last panel wherein remaining ones of said plurality of panels are positioned between said first and last panels, said first panel having a handle coupled thereto.

5. The assembly according to claim 4, wherein said last panel has a strap coupled thereto.

6. The assembly according to claim 5, wherein said first panel is positioned above each of said other panels and is free of any of said posts.

* * * * *